US005280297A

United States Patent [19]

Profera, Jr.

[11] Patent Number: 5,280,297

[45] Date of Patent: Jan. 18, 1994

[54] ACTIVE REFLECTARRAY ANTENNA FOR COMMUNICATION SATELLITE FREQUENCY RE-USE

[75] Inventor: Charles E. Profera, Jr., Cherry Hill, N.J.

[73] Assignee: General Electric Co., East Windsor, N.J.

[21] Appl. No.: 864,045

[22] Filed: Apr. 6, 1992

[51] Int. Cl.[5] ..... H01Q 19/06

[52] U.S. Cl. ..... 343/754; 343/700 MS; 343/797

[58] Field of Search ..... 343/754, 700 MS, 797; 455/276; 342/372

[56] References Cited

U.S. PATENT DOCUMENTS

Re. 28,217 10/1974 Malech ..... 343/754

4,684,952 8/1987 Munson et al. ..... 343/754

*Primary Examiner*—Donald T. Hajec

*Assistant Examiner*—Hoanganh Le

*Attorney, Agent, or Firm*—W. H. Meise; C. A. Berard; S. A. Young

[57] ABSTRACT

An antenna suited for a communications satellite includes two separately located, mutually orthogonally polarized feed antennas such as vertically and horizontally polarized linear horns. The horns feed an active reflector antenna array. The array includes a plurality of mutually orthogonally polarized antenna elements such as crossed dipoles or square patch antenna with cross feeds for two independent orthogonal polarizations. The feeds of the antenna elements are coupled to amplifier modules. Each module includes a circulator for each polarization, coupled to a processor including a low noise amplifier, controlled phase shifter, variable gain amplifier and power amplifier. The output of the power amplifier feeds the antenna element through the circulator. The large number of radiating elements allows high power using power amplifier with relatively modest capabilities. The phase shifters of each module independently control the reradiation phase of the vertical and horizontal signals, so that a collimated beam can be independently focused to the two feed points, one for each polarization.

20 Claims, 2 Drawing Sheets 398
332
392
394
340
394
332
310
378
H
V
392
388
412
422
411
410
LNA
414
PA
420
421
LNA
424
PS
416
VGA
418
PA
430
PS
426
VGA
428
MEM
444
446
442
440
342
369
368
386
384
392
332
394
376
340
374
310
388
378
MODULE OF FIG. 4
410
MODULE OF FIG. 4
410

ACTIVE REFLECTARRAY ANTENNA FOR COMMUNICATION SATELLITE FREQUENCY RE-USE

BACKGROUND OF THE INVENTION

This invention relates to antennas, and more particularly to satellites with dual-polarization antennas including a separate feed for each polarization.

Communication satellites are in widespread use for communicating data, video and other forms of information between widely spaced locations on the earth's surface. It is well known that communication satellites are expensive, and that they have a lifetime which is limited by consumption of expendables, notably consumption of propellant which is used for attitude control and for North-South stationkeeping. In order to provide as much propellant as possible at the beginning of a spacecraft's life, the weight of every portion of the spacecraft is scrutinized, and costly tradeoffs are made to save weight to allow on-loading of additional propellant to extend the life of the satellite. The value of a single month of additional operation of a satellite can be millions of dollars, so a weight saving of even a few pounds, for which propellant can be substituted, may result in tens of millions of dollars of savings.

Among the larger structures on the spacecraft are the solar panels, which require a relatively large surface facing the sun in order to intercept sufficient energy to generate electricity for the spacecraft's operation, and the transmitting and receiving antennas.

The antennas are transducers between transmission lines and free space. A general rule in antenna design is that, in order to "focus" the available energy to be transmitted into a narrow beam, a relatively large "aperture" is necessary. The aperture may be provided by a broadside array, a longitudinal array, an actual radiating aperture such as a horn, or by a reflector antenna which, in a receive mode, receives a collimated beam of energy and focuses the energy into a converging beam directed toward a feed antenna, or which, in a transmit mode, focuses the diverging energy from a feed antenna into a collimated beam.

Those skilled in the art know that antennas are reciprocal devices, in which the transmitting and receiving characteristics are equivalent. Generally, antenna operation is referred to in terms of either transmission or reception, with the other mode being understood therefrom.

For various reasons relating to reliability, light weight and cost, many current communication satellites employ "frequency re-use" communications systems. Such a system is described, for example, in U.S. patent application Ser. No. 07/772,207, filed Oct. 7, 1991 in the name of Wolkstein. In a frequency re-use system, independent signals are transmitted from a earth station over a plurality of band limited "channels" which partially overlap in frequency. At the transmitting earth station, mutually adjacent channels are cross-polarized. In this context, cross-polarization means that the signals of a particular channel are transmitted with a particular first polarization, while the signals of the two adjacent channels are transmitted at a second polarization orthogonal to the first. Ordinarily, each of the two orthogonal polarizations are two linear polarizations, which may be referred to as "vertical" and "horizontal", although, as known, precipitation causes rotation of the polarization. In principle, the two orthogonal channels could be right and left circular polarizations, but linear vertical and horizontal are more easily controlled. At the satellite, the vertically and horizontally polarized signals are separated by polarization-sensitive antennas and applied to separate transmission lines. This has the result which, in each channel, tends to suppress the signals relating to the two adjacent channels. Thus, even though the frequencies of the signals in each channel partially overlap, the overlapping frequency adjacent-channel signals are suppressed, which tends to reduce interchannel interference.

In the satellite, the received signals from the vertically and horizontally polarized antennas are converted to a different frequency range, filtered, and amplified by an amplifier within each channel, to produce independent signals in adjacent channels with partially overlapping frequencies within the converted frequency range, which independent signals are then combined or demultiplexed, and every other (or alternate) channels are applied to one polarization of a dual polarization antenna for retransmission back to the earth. As in the case of the receiving or uplink antenna, the transmitting or downlink antenna tends to maintain a degree of isolation between each channel and its immediate neighbors.

A prior art antenna which has been used for communication satellites includes a first reflector made up of mutually parallel, "vertically" polarized conductors lying along a surface having the shape of a parabola of revolution, and having a focus at which a vertically polarized feed antenna structure is located. Vertically polarized signals are reflected by the first reflector acting as a parabolic reflector, to collimate diverging signals radiated by the feed antenna to form a collimated beam which is directed toward the ground station, and for receiving collimated signals from the ground station and focusing the collimated signals onto the feed antenna. Horizontally-polarized signals, however, pass unimpeded through the vertically polarized conductive elements of the first reflector. A second reflector, located immediately before or immediately after the first reflector, consists of a plurality of mutually parallel, "horizontally" polarized conductive elements, forming a second parabolic reflector having a focal point at a second location different from that of the first focal point. A horizontally polarized feed antenna structure is located at the second focal point.

The above-described prior art antenna requires two separate parabolic reflectors, each formed from a elongated conductive grid, and each with a different focal point. The fabrication of the supports which lie between the two reflectors is difficult, and its presence tends to distort the radiation pattern of the rearmost reflector.

The weight demands on spacecraft militate against large antennas in favor of small antennas, which tend to require greater available transmitter power to achieve the desired carrier-to-noise (C/N) ratio, which in turn tends to require larger solar panels to energize more powerful amplifiers. As an alternative, smaller antennas can be used to achieve a given gain and C/N, if a higher operating frequency is used.

The demands for improved and lower-cost communications have driven communication satellites toward higher transmitted power and longer life. The long life and reliability considerations tend to favor use of solid-state amplifiers, while the high power and high frequency considerations favor the use of travelling-wave tube amplifiers. A way to achieve high power by paralleling solid state amplifiers is described in U.S. Pat. No. 4,641,106, issued Feb. 3, 1987 in the name of Belohoubek et al. Such schemes may be difficult to implement and may not achieve as much output power as a single travelling-wave tube. Another paralleling scheme is described in U.S. Pat. No. 5,103,233, issued Apr. 7, 1992 in the name of Gallagher et al. In the Gallagher et al scheme, an active array antenna includes radiating elements (radiators) on a radiating face of the antenna. Each of the antenna elements is driven by an amplifier of a transmit-receive module in a transmit mode, and, in a receive mode, drives a low-noise amplifier of the module. The phase distribution of the array is established in part by the distribution of an interior feed antenna which radiates to and from a second set of antenna elements on the interior of the array. Phase shifters associated with each transmit-receive module divert or steer the beam relative to broadside. This system may be difficult to implement in a lightweight system.

SUMMARY OF THE INVENTION

An antenna system includes an array of elements responsive to a first polarization and a second array, associated with the first, which is responsive to a second polarization, orthogonal to the first. In a preferred embodiment, the array is planar. First and second mutually orthogonally polarized feed antenna structure are offset from the plane of the array for transducing signals to space by way of the array. Each antenna element of the array is associated with at least an amplifier and a phase shifter. The net gain of the amplifier and the phase of the phase shifter are selected, in conjunction with the pattern of the feed antenna arrangement, to produce a collimated beam of energy in response to transmissions from the feed antenna, and to produce a beam of energy converging toward the feed antenna arrangement in response to receipt of a collimated electromagnetic beam. The amplifiers distributed across the planar array amplify the transmitted signal, thereby reducing the requirements placed upon the amplifier driving the feed antenna arrangement.

DESCRIPTION OF THE INVENTION

Figure 1:
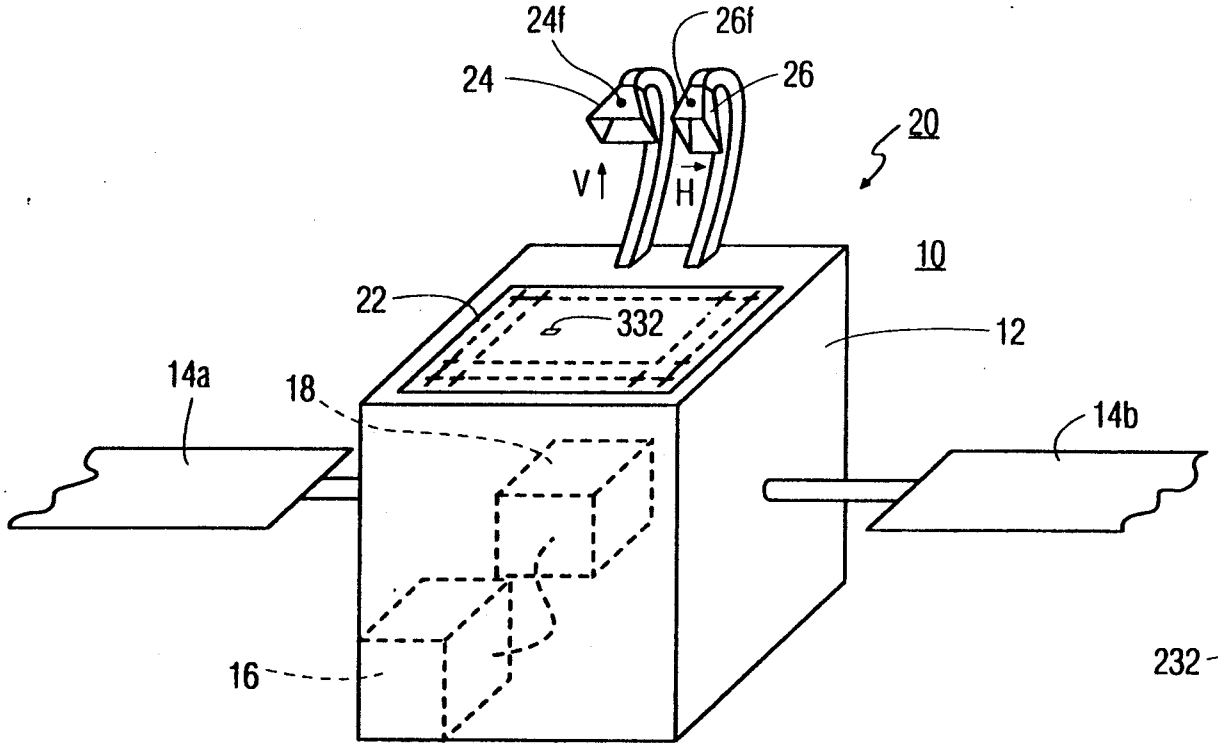
FIG. 1 is a simplified perspective or isometric view of a portion of a spacecraft including an antenna in accordance with the invention.

FIG. 1 is a perspective or isometric of a simplified communications satellite designated generally as 10, including a body 12, upon which are mounted solar panels illustrated as 14*a* and 14*b*. Solar panels 14*a* and 14*b* produce electrical energy which is supplied to electrical power control and routing circuits illustrated as a block 16, which produces power for communication circuits including amplifiers, linearizers, phase shifters, and the like, illustrated together as a block 18. The circuits of block 18 coact with a transmit-receive antenna designated generally as 20 which includes a dual-polarized planar antenna array illustrated as 22, in conjunction with two separate, mutually-orthogonally-polarized feed antenna structures, illustrated in FIG. 1 as waveguide-fed horn antennas 24 and 26, positioned at a location offset from the plane of the array. Horn 24 transmits and receives vertically (V) polarized signals, and horn 26 transmits and receives horizontally (H) polarized signals. Communications circuits 18 of FIG. 1 are coupled in known fashion with feed antennas 24 and 26.

Feed antenna arrangements 24 and 26 radiate diverging beams of energy of the two mutually orthogonal V and H linear polarizations toward array 22 in a transmit mode, and receive from array 22 beams of electromagnetic radiation converging toward phase centers 24*f* and 26*f*, respectively, of antennas 24 and 26. As so far described, the arrangement of FIG. 1 is similar to the arrangement described in copending patent application Ser. No. 07/848,055, entitled, "A Reflectarray Antenna For Communication Satellite Frequency Re-Use Applications", filed Mar. 9, 1992 in the name of Profera.

In the above-mentioned Profera application, each element of array 22 includes two mutually-orthogonally-polarized electromagnetic reflectors. The use of reflectors requires that, in order to achieve a given carrier-to-noise (C/N) ratio, feed antennas 24 and 26 must radiate the full power to be transmitted, plus an additional amount to compensate for any losses which occur in the reflector elements.

In accordance with an aspect of the invention, each element of array 22 includes cross-polarized antennas, each of which is coupled to a separate amplifying and phase shifting module.

Figure 2B:
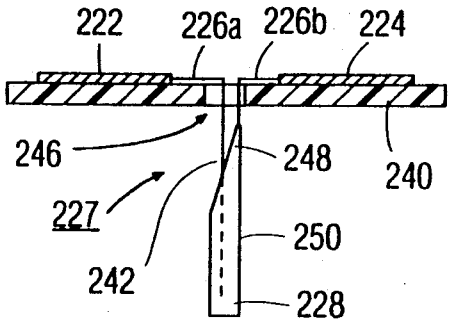
FIG. 2*b* is a side elevation view of a portion of the antenna of FIG. 2*a*.
Figure 2A:
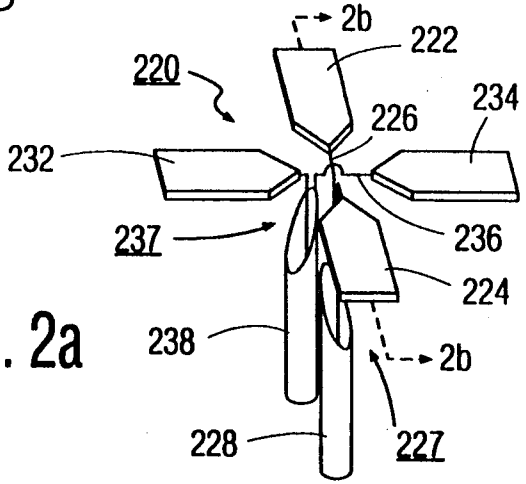
FIG. 2*a* illustrates a planar crossed-dipole antenna which may be used in the antenna array of FIG. 1.

FIGS. 2*a* and 2*b* are simplified perspective or isometric views and simplified elevation cross-sectional views, respectively, of one type of antenna element which may be used in array 22 of FIG. 1. In FIG. 2*a*, an array element designated generally as 220 includes a first dipole with elements 222, 224 interconnected by wires or conductors illustrated as 226 with a balun, in this case illustrated as a split-tapered or "infinite" balun 227. Balun 227 connects to a coaxial transmission line (coax line) 228. A second dipole includes dipole elements 232 and 234, similarly interconnected with each other and with a coax line 238 by conductors 236 and a balun 237. FIG. 2*b* is a simplified elevation cross-section of antenna elements 222, 224 and balun 227, viewed in the direction of section lines 2*b*—2*b* of FIG. 2*a*, and also illustrating a dielectric support substrate 240. As illustrated in FIG. 2*b*, antenna element 222 is connected by a conductor 226*a* to the center conductor 242 of coax line 228. Center conductor 242 of coax line 228 extends through an opening or aperture 246 formed in substrate 240 between antenna elements 222 and 224. A balanced-to-unbalanced transition (balun) 227 is provided by a taper 248 of the outer conductor 250 of coaxial transmission line 244. The narrow tapered end of outer conductor 250 also extends through aperture 246 and is connected by conductor 226*b* to dipole element 224. Dipole antenna elements 232 and 234 of FIG. 2*a* are similarly connected to coaxial transmission line 238.

Figures 3A, 3B, 4:
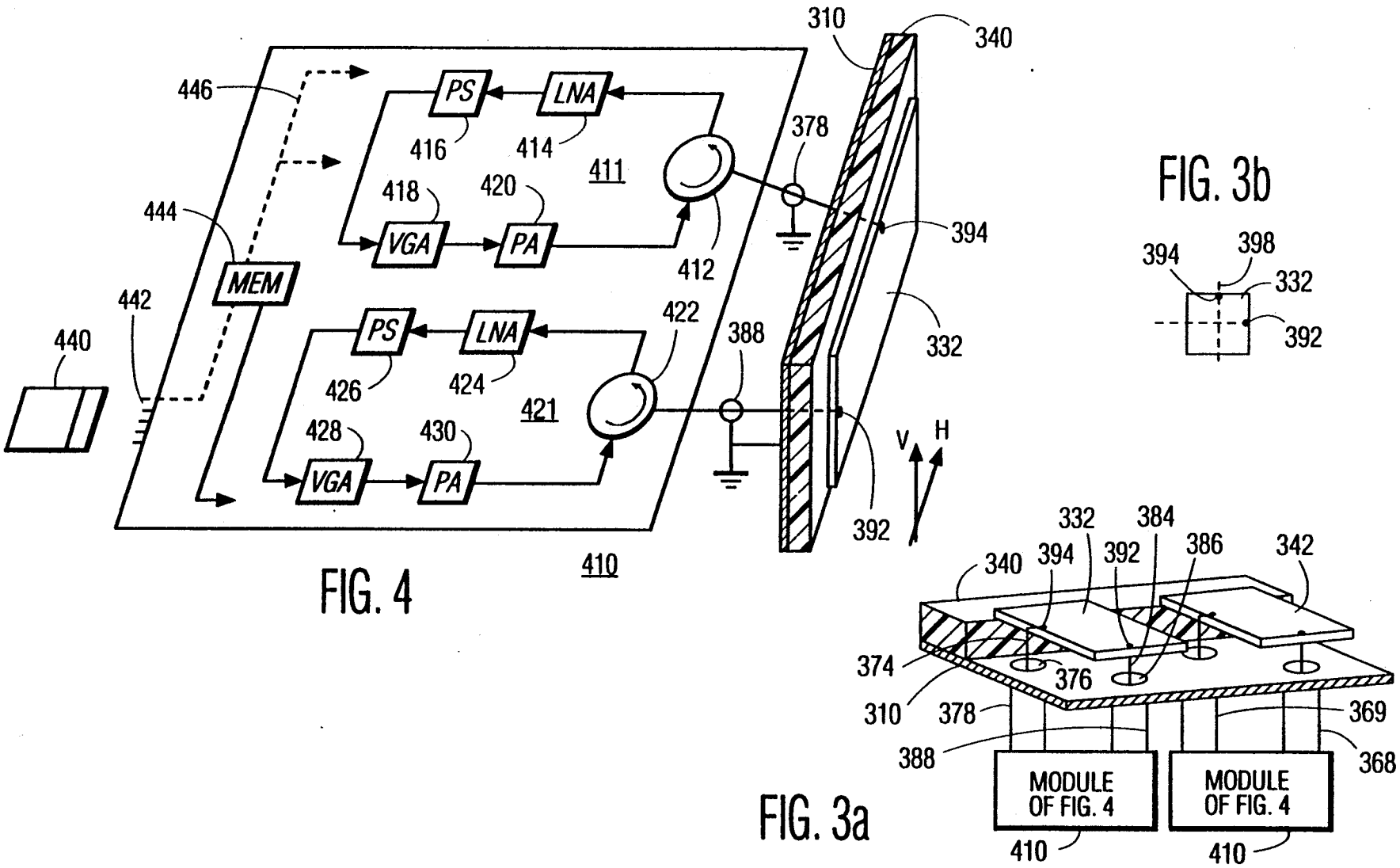
FIG. 3*a* and 3*b* are perspective or isometric views partially cut away, of a portion of the array of FIG. 1, illustrating a planar patch antenna.
FIG. 4 is a simplified block diagram of a typical connection to a patch antenna of the array of FIG. 1.

FIG. 3*a* is a perspective or isometric view, partially cut away, of two patch-type antenna elements which may be used in part of array 22 of FIG. 1. In FIG. 3, a dielectric substrate illustrated as 340 has a conductive ground plane 310 associated with the lower side, and a plurality of rectangular or square patch antenna elements 332, 342 supported by the upper side of dielectric substrate 340. As known to those skilled in the art and as illustrated in FIG. 3b, each patch, such as patch 332 of FIG. 3b, may be biaxially symmetric about mutually orthogonal axes 396 and 398, and may be fed at points illustrated as 392, 394 which are symmetrically placed relative to the axes. Such feeding with appropriately dimensioned patch antennas, results in radiation of electromagnetic energy with mutually orthogonal linear polarizations. As illustrated in FIG. 3a, point 392 is fed by the center conductor 384 of a coaxial cable 388 which extends through an aperture 386 in ground plane 310, and through the adjacent dielectric support 340 to point 392 on patch antenna 332. The outer conductor of coax line 388 connects to ground plane 310. Similarly, feed point 394 is driven by the center conductor 374 of a coaxial transmission line 378, which extends through an aperture 376 in ground plane 310 to point 394, and which has its outer conductor connected to ground plane 310. Similar coax lines, designated 368 and 369, are associated with patch antenna 342.

As also illustrated in FIG. 3a, coaxial cables 378, 388 by which patch antenna 432 is fed, are coupled to a module designated 410, described in greater detail in conjunction with FIG. 4.

FIG. 4 illustrates details relating to a module 410 of FIG. 3a, and its interaction with a patch antenna and with the array. In FIG. 4, module 410 includes a circulator 412 coupled to receive signal from coaxial cable 378 in response to signals received by patch antenna 332 in a first polarization, illustrated as V. Circulator 412 couples the received signal to a processor designated generally as 411, which includes a low noise amplifier (LNA) 414 which amplifies weak signals, such as those received from an earth station, which applies the amplified signals to a phase shifter (PS) illustrated as a block 416. Phase shifter 416 provides phase shifts selected as described below, and applies the phase shifted signals to a variable gain amplifier (VGA) or variable attenuator 418, which adjusts the signal level. The phase shifted, gain adjusted signal is applied from VGA 418 to a power amplifier (PA) 420, which amplifies the signal and applies it as a processed signal to circulator 412, which circulates the amplified signal back to coaxial cable 478 for application to feed point 394 of patch antenna 332 for reradiation.

In a similar manner, circulator 422 of module 410 receives signal from coaxial cable 388 in response to the reception by patch antenna 332 of electromagnetic radiation of the other linear polarization, illustrated in FIG. 4 as H, and couples it to a low noise amplifier 424 of a processor 421. Processor 421 also includes a phase shifter 426, variable gain amplifier 428, and power amplifier 430, which applies the signal back to circulator 422 for application to feed point 392 of patch antenna 332. Patch antenna 332 reradiates amplified signal of the second polarization.

Those skilled in the art will realize that substantial amplification can be used in each processor, at frequencies at which the return loss of the patch antenna exceeds the gain.

Each module may have its phase shifter 416 preset to a value which causes the vertically polarized energy received from a collimated beam, as for example an array beam directed towards a distant earth station, to be reradiated from the particular location at which module 410 is placed within the array and to coact with other modules with different phase shifter settings, to cause the vertically polarized reradiated beam to converge towards focal point 24f of vertically polarized feed antenna 24. Similarly, at that same location of module 410, phase shifter 426 would be set to cause the horizontally polarized reradiated signal from patch 332, responsive to a collimated beam, to converge towards focal point 26f of horizontally polarized feed antenna 26 of FIG. 1. Because of the reciprocity of transmit and receive functions, this in turn will result in a diverging beam of energy from focal point 24f of vertically polarized feed antenna 24 arriving at the various points on antenna array 22 so that the energy reradiated by patch 332 in response to signal applied to feed point 394 of FIG. 4 will, together with other reradiated signals originating from other patch antenna of array 22, form a collimated directed towards the distant location. Similarly, the horizontally polarized signal diverging from focal point 26f of horizontally polarized feed antenna 26 of FIG. 1 will arrive at the various patch antennas with a phase which, when processed by the appropriate phase shifter 426, will result in a collimated beam.

The variable gain amplifiers are set to provide the desired amount of amplitude taper across the radiating aperture of the array. In particular, each VGA is set to a value which controls the amplitude of its own antenna element relative to that of the other antenna elements. In general, those antenna elements or radiators nearest the center of the array will have their associated variable gain amplifiers set for gain greater than the gain of variable gain amplifiers associated with antenna elements near the edge of the array. Such tapered distributions reduce the magnitude of sidelobes. Some of the amplitude tapering is provided by the taper element in the feed antennas. Those skilled in the art will know how to determine the taper provided by the feed horn, and the amount of taper which must be imparted by the VGAs.

A socket is provided for each module by which energizing power is coupled to the module from power control 16 of FIG. 1, to operate the LNA, PS, VGA and PA. The socket associated with module 410 is illustrated as 440 in FIG. 4. Socket 440 mates with a corresponding plug 442 associated with module 410, to couple energizing power to the various portions of the module from a common power supply (not illustrated) associated with the array. In order to avoid individual adjustment of the phase shifters and variable gain amplifiers of each module as it is inserted into the array, the socket may be keyed to its particular location by means of jumpers, index pins, or the like, so that it "knows" where it is in the array by a unique mechanical or electrical code. This code is translated into address information for a memory (MEM) 444, which is pre-loaded with information defining the settings of the phase shifters and the variable gain amplifiers for all possible locations in the array. Thus, when a module is inserted into the holder, the memory is addressed at a location at which the stored information represents the phase and amplitude settings required to provide the transition between collimated beams and converging or diverging beams directed toward the two different faces, depending upon polarization.

An alternative which provides more flexibility and which reduces the cost of preloaded memory on each module, substitutes one or more latches coupled to an array controller, for receiving and storing digital control information distributed over a bus to all modules, and addressed to each individual module. The information can be supplied sequentially to each module, thereby limiting the size of the control bus. The latches preserve the digital information identified or addressed to that particular module between access times. One or more digital-to-analog converters coupled to the latches convert the stored control information into analog control signals for control of the phase shifter and variable gain amplifier. As a yet further alternative, digitally controlled phase shifters and variable gain amplifiers may be coupled directly to the latches.

Other embodiments of the invention will be apparent to those skilled in the art. For example, each of the feed antennas illustrated in FIG. 1 as a horn 24 or 26 may instead be an independent array antenna. While the preferred embodiment uses modules for each antenna of the array which provide both amplitude tapering and phase control, the appropriate phase may be provided by the inherent delay of the amplifier, so that no discrete phase shifter is necessary, and in a similar manner, no discrete variable amplitude control may be necessary in particular applications. While removable "modules" have been described, fixed, nonremovable equivalents may be used. The antenna may be made an integral part of its associated module. While the array has been illustrated as being planar, the amount of module-to-module phase shift which must be imparted may be reduced if the surface is curved into an approximation of a parabola of revolution.

What is claimed is:

1. An antenna system, comprising:

a first plurality of first transducer antenna element means, each of said first transducer antenna element means including an active portion and also including a connection port at which signals are generated in response to reception of electromagnetic radiation of a first polarization by said active portion of said first transducer antenna element means, and which first transducer antenna element means radiates electromagnetic energy of said first polarization from said active portion in response to signals applied to said connection port;

a second plurality, of second transducer antenna element means, each of said second transducer antenna element means including an active portion and also including a connection port at which signals are generated in response to reception by said active portion of electromagnetic radiation of a second polarization, orthogonal to said first polarization, and which second transducer antenna element means radiates electromagnetic energy of said second polarization in response to signals applied to said connection port;

arraying means coupled to said first and second antenna element means for arraying said active portions of said first and second antenna element means in at least an array direction to define an array surface, with each of said transducer antenna element means oriented for transducing radiation of its polarization;

first feed antenna means mounted at a first location offset from said array surface, for transducing electromagnetic radiation of said first polarization flowing in (a) a converging manner from said array surface toward said first feed antenna means, and (b) flowing in a diverging manner from said first feed antenna means toward said array surface;

second feed antenna means mounted at a second location offset from said array surface, different from said first location, for transducing electromagnetic radiation of said second polarization flowing in (a) a converging manner from said array surface toward said second feed antenna means, and (b) flowing in a diverging manner from said second feed antenna means toward said array surface;

a plurality, equal to said first plurality, of first processing means, each of said first processing means being coupled to said connection port of an associated one of said first transducer antenna element means, for receiving signals from said associated one of said first transducer antenna element means in response to said electromagnetic radiation flowing in said diverging manner from said first feed antenna means to produce first received signals, and for at least amplifying said first received signals, and for phase controlling said first received signals in accordance with the location within said first antenna array of said associated one of said first transducer antenna element means for generating first processed signals, and for applying said first processed signals to said connection port of said associated on of said first transducer antenna element means, for causing said first antenna array to generate an amplified, collimated beam of electromagnetic radiation in response to said diverging beam of electromagnetic radiation flowing from said first feed antenna means to said array surface, and for causing said first array to generate an amplified beam of electromagnetic energy converging toward said first feed antenna means in response to receipt of a collimated beam of electromagnetic energy of said first polarization;

a plurality, equal to said second plurality, of second processing means, each of said second processing means being coupled to said connection port of an associated one of said second transducer antenna element means, for receiving signals from said associated one of said second transducer antenna element means in response to said electromagnetic radiation flowing in said diverging manner from said second feed antenna means to produce second received signals, and for at least amplifying said second received signals, and for phase controlling said second received signals in accordance with the location within said second antenna array of said associated one of said second transducer antenna element means for generating second processed signals, and for applying said second processed signals to said connection port of said associated one of said second transducer antenna element means, with phase selected for causing said second antenna array to generate an amplified, collimated beam of electromagnetic radiation in response to said diverging beam of electromagnetic radiation flowing from said second feed antenna means to said array surface, and for causing said second array to generate an amplified beam of electromagnetic energy converging toward said second feed antenna means in response to receipt of a collimated beam of electromagnetic energy of said second polarization.

2. A system according to claim 1, wherein each of said first transducer antenna element means is associated in a single structure with one of said second transducer antenna element means.

3. A system according to claim 2, wherein said single structure is a planar patch antenna, in which the plane of said patch is coincident with said array surface.

4. A system according to claim 3, wherein said patch antenna is biaxially symmetric.

5. A system according to claim 3, wherein said patch antenna is supported by a dielectric plate, and is feed at biaxially symmetric location.

6. A system according to claim 1, wherein at least one of said first and second feed antenna means comprises a horn antenna.

7. A system according to claim 6, wherein said horn antenna is linearly polarized.

8. A system according to claim 1, wherein said array surface is planar.

9. A system according to claim 1, wherein each one of said first and second processing means includes an input port for receiving said second signals and an output port at which said processed signals are generated; and further comprising a circulator coupled to each of said first and second transducer antenna element means, each said circulator including a first port coupled to said connection port of its associated transducer antenna element means, and also including second and third ports, said second port being coupled to said input port of the associated one of said first and second processing means, for coupling signal principally from said connection port to said input port of said one of said processing means, said third port of said circulator being connected to said output port of said associated one of said first and second processing means, for coupling the associated one of said first and second processed signals to the associated one of said first and second transducer antenna element means.

10. A system according to claim 1, wherein said first and second arrays are two-dimensional arrays.

11. A system according to claim 1, further comprising:

a satellite body affixed to said arraying means for support thereof;

powering means supported by said body for generating electrical power; and power control and distribution means coupled to said solar powering means and to said firs and second processing means for energizing said first and second processing means.

12. A system according to claim 11, wherein said powering means comprises a solar panel.

13. A system according to claim 11, wherein at least one of said first and second feed antenna means comprises a horn antenna.

14. A system according to claim 13, wherein said horn antenna is linearly polarized.

15. A system according to claim 1, wherein said first plurality equals said second plurality.

16. An antenna system comprising:

a plurality of antenna element means, each of said antenna element means including active portions, and also including first and second connection ports at which received signals are generated in response to reception of electromagnetic radiation of first and second polarizations, respectively, by said active portions of said antenna element means, and which active portions of said antenna element means radiate electromagnetic energy of said first and second polarizations, respectively, in response to signals applied to said first and second connection ports, respectively;

arraying means for arraying said antenna element means to form an antenna array with an array surface, said antenna element means being oriented in said array so as to cause said first and second polarizations of each of said antenna element means to be mutually parallel, for transponding radiation flowing in a direction other than parallel to said array surface;

feed antenna means located at a position offset from said array surface for transducing electromagnetic radiation of said first and second polarizations flowing (a) in a converging manner from said array surface toward said feed antenna means, and (b) in a diverging manner from said feed antenna means toward said array surface; and processing means associated with each of said antenna element means, and coacting with others of said processing means, for receiving first and second received signals from the associated one of said antenna element means in response to said first and second polarizations, respectively, of said electromagnetic radiation flowing in a diverging manner from said feed antenna means, and for at least amplifying each of said received signals separately to produce amplified signals, and for coupling said amplified signals back to said associated antenna element means, with relative phase selected for causing said antenna element means of said array to generate first and second amplified, collimated beams of electromagnetic radiation, and for causing said antenna elements of said array to generate first and second amplified beams of electromagnetic energy converging toward said feed antenna means in response to receipt of first and second collimated beams of electromagnetic energy of said first and second polarizations, respectively.

17. A system according to claim 16, wherein each of said antenna element means is a planar patch antenna, in which the plane of said patch is coincident with at least a local portion of said array surface.

18. A system according to claim 17, wherein said patch antenna is biaxially symmetric.

19. A system according to claim 16, wherein each one of said processing means includes an input port for receiving said received signals and an output port at which said processed signals are generated; and further comprising first and second circulators coupled to each of said antenna element means, each of said circulators including a first port coupled to said connection port of its associated antenna element means for responding to one of said first and second received signals, and also including second and third ports, said second port of each of said circulators being coupled to an input port of an associated one of first and second portions of said processing means, for coupling one of said first and second received signals to said input port of said one of said portions of said processing means, said third port of each of said circulators being connected to an output port of one of said associated ones of said first and second portions of said processing means, for coupling said signals to said antenna element means for reradiation.

20. A system according to claim 16, wherein said feed antenna means comprises first and second feed antenna portions ,said first and second feed antenna portions being responsive to said first and second polarizations, respectively, and being located at mutually different, adjacent first and second locations, respectively, said first and second locations being offset from said array surface, and adjacent said position offset from said array surface.

* * * * *